United States Patent [19]

Sanada et al.

[11] Patent Number: 4,534,848

[45] Date of Patent: Aug. 13, 1985

[54] COAL LIQUEFACTION WITH A SELENIUM CATALYST

[75] Inventors: Yuzo Sanada; Susumu Yokoyama, both of Sapporo; Tadatoshi Chiba, Ishikari; Tetsuro Yokono, Sapporo; Hiroshi Moritomi, Sapporo; Toshiyuki Obara, Sapporo; Hiroshi Nagaishi, Sapporo, all of Japan

[73] Assignee: Hokkaido University, Sapporo, Japan

[21] Appl. No.: 671,045

[22] Filed: Nov. 13, 1984

[30] Foreign Application Priority Data

Jan. 26, 1983 [JP] Japan ..... 58-11146

[51] Int. Cl.[3] ..... C10G 1/00

[52] U.S. Cl. ..... 208/10

[58] Field of Search ..... 208/10

[56] References Cited

U.S. PATENT DOCUMENTS

| | | | |
|---|---|---|---|
| 4,218,337 | 8/1980 | McKay | 208/10 |
| 4,251,500 | 2/1981 | Morita et al. | 423/449 |
| 4,303,497 | 12/1981 | Mitchell et al. | 208/10 |

*Primary Examiner*—D. E. Gantz
*Assistant Examiner*—Lance Johnson
*Attorney, Agent, or Firm*—Spencer and Frank

[57] ABSTRACT

Disclosed are a catalyst for direct liquefaction of coal, which consists of selenium, a selenium compound, or a mixture of selenium or the selenium compound with a metal oxide, and a method of directly liquefying coal in the presence of such a catalyst.

5 Claims, No Drawings

COAL LIQUEFACTION WITH A SELENIUM CATALYST

This is a division of application Ser. No. 06/543,314 filed Oct. 18, 1983.

BACKGROUND OF THE INVENTION (1) Field of the Invention:

The present invention relates to a catalyst for direct liquefaction of coal and a method of directly liquefying coal by using such a catalyst. More specifically, the invention is to provide a catalyst for direct liquefaction of coal which has a high catalytic activity and is cheap, and to provide an industrially advantageous method of directly liquefying coal by using such a catalyst.

(2) Description of the Prior Art:

The technique of directly liquefying coal is to convert solid coal into liquid hydrocarbons, and includes thermal cracking, hydrogenation, hydrogenolysis and the like from the standpoint of the chemical reaction. Among them, the hydrogenation and the hydrogenolysis are slow in the reaction rate, so that it is necessary to use a catalyst for accelerating the reaction. As the catalyst, there are (A) metal chlorides, (B) metal oxides and the like. The metal chloride catalyst (A) (e.g. zinc chloride, antimony chloride, tin chloride and the like) is a powerful catalyst but is corrosive and therefore has not been industrially successful. As the metal oxide catalyst (B), there have been well known oxides of iron, nickel, cobalt, molybdenum, tungsten and the like. Among them, nickel, molybdenum, and tungsten are expensive and/or have problems with sulfur resistance. Accordingly, cheap and disposable iron oxide catalysts are promising and have been used with sulfur as a promotor in recently developed coal liquefaction processes. However, the iron oxide-sulfur (or iron sulfide)-combined catalyst is lower in the catalytic activity than molybdenum or tungsten oxide catalyst. Consequently the volume of the reactor must be larger and the construction cost of the system becomes more expensive. Under these circumstances, a need exists for an effective, inexpensive catalyst that is sulfur resistant.

SUMMARY OF THE INVENTION

The inventors have found a catalyst of selenium or a selenium compound, when employed alone or in combination with a metal oxide such as iron oxide or the like, exhibits a high catalytic activity and is inexpensive.

Within the invention, the catalyst for direct liquefaction of coal consists of selenium, a selenium compound, or a mixture of selenium or the selenium compound with a metal oxide. Further, the invention provides a method of directly liquefying coal which comprises heating powdered coal with hydrogen to a temperature of 400°–470° C. under a pressure of 1–200 atms in the presence of a catalyst consisting of selenium, a selenium compound, or a mixture of selenium or the selenium compound with a metal oxide.

BRIEF DESCRIPTION OF THE DRAWINGS

FIG. 1 is a graph showing the temperature dependence of transferable hydrogen $H_{DHA}$ in Shin Yubari coal in the presence of the catalyst of to the invention.

FIG. 2 is a graph showing the relationship between the transferable hydrogen $H_{DHA}$ and the retention time for Shin Yubari coal in the presence of the catalyst of the invention when the reaction temperature is maintained 400° C.

FIG. 3 is a graph showing the relationship between the radical concentration produced from Akabira coal and the retention time at 420° C. in the presence of the catalyst of the invention.

FIG. 4*a* is a graph showing a change of the yield of the pyridine soluble component with the lapse of time in a direct liquefaction reaction using the catalyst according to the invention and the comparison catalyst.

FIG. 4*b* is a graph showing a change of the yield of the benzene soluble component with the lapse of time in the same reaction as in FIG. 4*a*.

DETAILED DESCRIPTION OF THE INVENTION

As mentioned above, the invention relates to a catalyst for the direct liquefaction of coal and a method of for directly liquefying coal using such a catalyst. As a result of our studies with respect to the hydrogen transfer in the course of the coal liquefaction reaction, it was found that the conventionally known coal-liquefying catalysts ultimately have the effect of accelerating the hydrogen transfer. The inventors have been the first to discover through the above studies that selenium, a selenium compound, or a mixture of selenium or the selenium compound with a metal oxide exhibit an extremely effective catalytic action.

The catalyst for direct liquefaction of coal according to the invention is selenium, a selenium compound or a mixture of selenium or the selenium compound with a metal oxide. As the metal oxide, there are used metal oxide catalysts such as iron oxide-based catalysts, e.g., red mud.

In the method of directly liquefying coal according to the invention, coal is used in powder form. However, the specific particle size of the powdered coal is not critical.

The liquefaction reaction is carried out by heating the powdered coal in a reactor such as an autoclave or the like together with hydrogen in the presence of the catalyst. Hydrogen is used under atmospheric or raised pressure, preferably 1 to 200 atms. In such a reaction, the use of a solvent is not essential, but is favorable from the standpoints of temperature control and handling of the reaction mixture. Suitable solvents include naphthalene, tetralin, anthracene and/or a process-derived oil. Particularly, it is more preferable to use hydrogen donor solvents such as hydronaphthalene, tetralin, hydroanthracene and the like. The reaction temperature is preferably within a range of 400°–470° C.

The following examples are given in illustration of the invention and are not intended as limitations thereof.

EXAMPLE 1

When coal is heated with anthracene under ordinary pressure, anthracene extracts transferable hydrogen bonded to the coal at specific positions to produce 9,10-dihydroanthracene (9,10-DHA) as shown in the following reaction formula (1).

In this formula, symbol M means a microstructure unit by which the hydrogen transfer and the decomposition reaction of the coal, is conducted and the bonds to adjacent M and H* are schematic representations of the bonds in question. Symbol H* means a transferable hydrogen bonded to the specific position on the coal among all the hydrogens bonded to the coal.

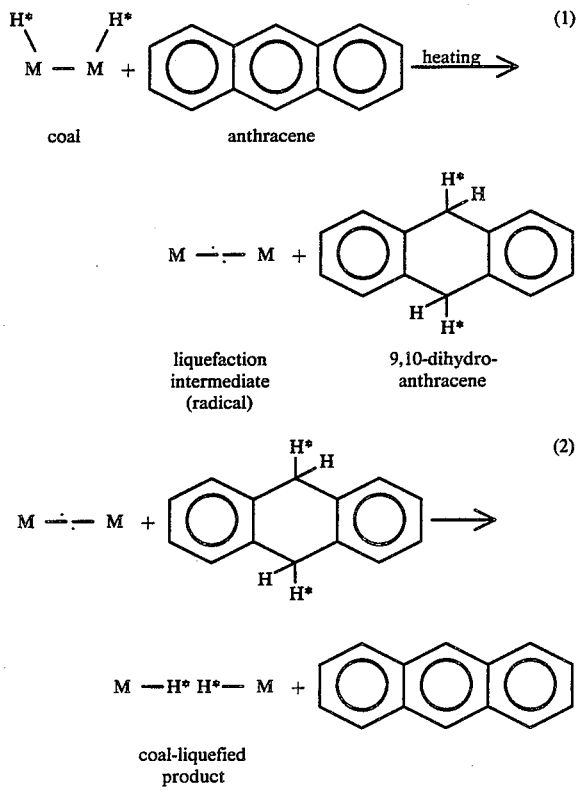

The reaction (1) takes place at a temperature of not less than 350° C. an under an atmospheric pressure. If selenium is added in an amount of 10% of the coal, the rate of reaction (1) is accelerated as shown in FIG. 1. In this figure the temperature dependence of transferable hydrogen $H_{DHA}$ in Shin Yubari coal, is shown wherein symbol o is the comparative case of treating only the coal, symbol ⊙ is the comparative case of adding $ZnCl_2$ to the coal, and symbol Δ is the case according to the invention of adding Se to the coal. These symbols are also used in FIGS. 2 and 3 as discussed below. In FIG. 1, the transferable hydrogen $H_{DHA}$ represents the amount (mg per unit gram of coal) of the transferable hydrogen H* transferred from the coal to anthracene and contained in the resulting 9,10-dihydroanthracene (hereinafter abbreviated as 9,10-DHA). The larger the value of $H_{DHA}$, the more the reaction (1) is accelerated.

From the experiments shown in FIG. 1, it is obvious that selenium exhibits a fairly strong catalytic action as compared with the conventional zinc chloride catalyst, which has been recognized as a powerful catalyst for liquefying coal.

FIG. 2 shows the change in the production rate of 9,10-DHA over time when the same reaction system as in FIG. 1 was kept at a constant temperature (400° C.). In these experiments, it was found that the use of selenium produces about three times the 9,10-DHA produced using zinc chloride.

It can be seen from FIGS. 1 and 2 that selenium is an excellent catalyst for hydrogen transfer reactions. (The hydrogen donating property of 9,10-DHA is forty times that of tetralin, a typical hydrogen donor solvent.)

The same experiment as described above was repeated using Taiheiyo coal and Akabira coal maintained at 400° C. under atmospheric pressure for 5 minutes producing the amount of transferable hydrogen shown in following Table 1.

TABLE 1

| Coal (100 mg) | Catalyst (3 mg) | $H_{DHA} \times 10^2$ |
|---|---|---|
| Taiheiyo coal | none | 3.98 |
| " | $ZnCl_2$ | 11.0 |
| " | Se | 36.3 |
| " | $SeO_2$ | 25.7 |
| Akabira coal | none | 3.38 |
| " | $ZnCl_2$ | 6.06 |
| " | Se | 60.6 |
| " | $SeO_2$ | 31.9 |

EXAMPLE 2

When the coal-liquefying reaction is proceeding based on mechanisms (1) and (2) at 420° C. under atmospheric pressure with hydrogen, the initiation reaction is a thermal depolymerization step. Radicals form due to homolysis of the crosslinkage in the coal structure. (The covalent bond composed of an electron pair is separated into individual neutral radicals [see reaction formula (1)].) The radical concentration may be determined by the high-temperature paramagnetic resonance absorption method which is a state of the art measuring method allowing the direct and unrestricted observation of radicals being produced as the reaction occurs.

FIG. 3 shows the concentration of radicals produced from Akabira coal, as measured by the high-temperature paramagnetic resonance absorption method at a temperature of 420° C. From FIG. 3, it is obvious that the radical concentration initially increases faster in the reaction system with selenium at a weight ratio of 1:1 to coal as compared with the reaction system with no selenium addition. Especially, the radical concentration produced in the coal-selenium system is higher than that in the coal-zinc chloride system during the first 10 minutes or so of the reaction. From the above experiments, it is apparent that selenium is extremely effective in the initiation reaction for liquefaction.

EXAMPLE 3

Based on the experimental results of Examples 1 and 2, selenium is an excellent catalyst for the initial liquefaction reaction. The following runs were carried out to demonstrate the advantages of this catalyst.

Three grams of Taiheiyo coal were charged into an electromagnetically stirred autoclave having an inner volume of 31 ml. The reactions were carried out with different solvents and catalysts as listed below. The amount of the catalyst was 0.33 g, the temperature was 450° C., the pressure was 100 atms, and the atmosphere was hydrogen.

Run A:
solvent—naphthalene,
catalyst—Se 0.33 g

Run B:
solvent—naphthalene,
catalyst—RM/Se 0.30 g/0.03 g

Run C:
solvent—tetralin,
catalyst—none

Run D:
solvent—naphthalene,
catalyst—RM/S 0.30 g/0.03 g

Note: RM means red mud.

In the above runs, the catalyst was added in an amount of 10% to the coal. A typical result obtained is shown in Table 2 and FIG. 4.

TABLE 2

| Run No. | Coal | amount charged (g) | Catalyst | amount present (g) | Reaction temperature (°C.) | Reaction pressure (kg/cm²) | Reaction time (min) | Solvent | Pyridine soluble matter (%) | Benzene soluble matter (%) |
|---|---|---|---|---|---|---|---|---|---|---|
| 1* | Taiheiyo coal | 3 | Selenium | 0.31 | 450 | $N_2$ 100 | 5 | — | 38.7 | 28.6 |
| 2 | " | 3 | Selenium | 0.33 | 450 | $H_2$ 100 | 5 | naphthalene | 79.1 | 62.7 |
| 3 | " | 3 | Selenium | 0.33 | 450 | $H_2$ 100 | 30 | naphthalene | 97.4 | 91.8 |
| 4 | " | 3 | Selenium | 0.33 | 450 | $H_2$ 100 | 5 | — | 46.9 | 36.0 |
| 5 | " | 3 | Selenium | 0.33 | 450 | $H_2$ 100 | 30 | — | 65.2 | 46.6 |
| 6 | " | 3 | Selenium.RM | 0.33 | 450 | $H_2$ 100 | 5 | naphthalene | 78.0 | 65.0 |
| 7 | " | 3 | Selenium.RM | 0.33 | 450 | $H_2$ 100 | 10 | naphthalene | 85.1 | 67.6 |
| 8 | " | 3 | Selenium.RM | 0.33 | 450 | $H_2$ 100 | 30 | naphthalene | 85.9 | 72.0 |
| 9* | " | 3 | Sulfur.RM | 0.33 | 450 | $H_2$ 100 | 5 | naphthalene | 56.1 | 28.5 |
| 10* | " | 3 | Sulfur.RM | 0.33 | 450 | $H_2$ 100 | 30 | naphthalene | 90.3 | 70.0 |
| 11* | " | 3 | $Co.Mo/Al_2O_3$ | 0.33 | 450 | $H_2$ 100 | 5 | naphthalene | 45.9 | 34.0 |
| 12* | " | 3 | $Co.Mo/Al_2O_3$ | 0.33 | 450 | $H_2$ 100 | 30 | naphthalene | 63.8 | 53.4 |
| 13 | Akabira coal | 3 | Selenium | 0.30 | 420 | $H_2$ 100 | 5 | — | 45 ± 5 (a), (b) | — |
| 14* | " | 3 | Zinc chloride | 0.30 | 420 | $H_2$ 100 | 5 | — | 30.2 (b) | — |
| 15 | Big Brown lignite | 3 | $SeO_2$ | 0.30 | 450 | $H_2$ 50 | 30 | — | — | 49.3 |

(Note)
*Comparative example
(a): This value varies due to the conversion rate of selenium to hydrogen selenide.
(b): The measurement was performed by the extraction with pyridine at room temperature. The conversion rate becomes higher in case of Soxhlet extraction.

From the above results, it was found that either selenium or the combination of red mud and selenium exhibits an excellent conversion rate (liquefying rate). For the comparison, there were used both red mud-sulfur catalyst and $Co.Mo/Al_2O_3$ catalysts, which have been known to be strong catalysts.

Particularly, the following points should be noted from these runs: (1) The conversion rate ($Y_{PS}$) to preasphaltene as well as the conversion rate ($Y_{BS}$) to asphaltene in the initial reaction stage (5–10 minutes) have been improved. This has great merit because the reaction time and reactor volume required for attaining a given conversion can both be reduced. Further, (2) the substitution of sulfur by selenium in the red mud-sulfur catalyst (weight ratio=10:1) exhibited a greater catalytic action. That is, selenium was considered to have an action as a promotor. In this case, the amount of selenium used was 1%. Moreover, it has been confirmed from a blank experiment that selenium reacts with hydrogen at the experimental temperature to convert about 20% of selenium to hydrogen selenide. Although it is theorized that the resulting hydrogen selenide accelerates the liquefying reaction, the detailed resolution of such a mechanism remains to be determined in the future.

In order to produce hydrogen selenide by the reaction between selenium and hydrogen, a temperature of 600°–700° C. is required for reaction equilibrium. In the coal-hydrogen-selenium experimental system, the odor of hydrogen selenide was present after the reaction. It is expected that the increase in the reaction temperature gives a greater conversion rate. However, it is impossible to confirm this fact using the apparatus now available and, therefore, further investigation must be done.

As mentioned above, when selenium, selenium a compound or a mixture of selenium or the selenium compound with a metal oxide is used as a catalyst for liquefying coal, the coal-liquefaction reaction can be accelerated. In particular, the catalyst and process of this invention produce a fairly lower molecular weight product (specifically, asphaltene component soluble in pyridine or benzene) about three times more than the conventional catalysts at the initial reaction stage. This is significant for the whole of the coal liquefaction process. More specifically, according to the invention, it is possible to shorten the time from charging the coal to recovery of the liquefied oil. It is also possible to reduce the size of the reactor and to reduce the capital investment and the factory site area. Further, since the catalyst of this invention is cheap and has substantially no corrosive activity (unlike the metal chloride catalyst), it can be advantageously employed in industry.

What is claimed is:

1. A method for the direct liquefaction of coal, comprising heating powdered coal, a catalyst, and hydrogen to a temperature of 400°–470° C. under a pressure of 1 to 200 atms wherein said catalyst consists of selenium, a compound of selenium, or a mixture of selenium or the compound of selenium with a metal oxide.

2. A method according to claim 3, wherein said liquefaction is carried out in a solvent selected from the group consisting of naphthalene, tetraline, anthracene and an oil produced in the liquefying process.

3. A method according to claim 1, wherein the metal oxide is an iron oxide.

4. A method according to claim 3, wherein the iron oxide is red mud.

5. A method according to claim 1, wherein the compound of selenium is $SeO_2$.

* * * * *